US007686169B1

(12) United States Patent
Harte

(10) Patent No.: US 7,686,169 B1
(45) **Date of Patent: *Mar. 30, 2010**

(54) PROTECTIVE CONTAINMENT OF VALUED ARTICLES

(75) Inventor: Glenn W. Harte, Denville, NJ (US)

(73) Assignee: Museum Quality Shipping, LLC, Mesquite, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/206,783

(22) Filed: Sep. 9, 2008

Related U.S. Application Data

(63) Continuation-in-part of application No. 11/203,760, filed on Aug. 15, 2005, now Pat. No. 7,422,112.

(51) Int. Cl.
*B65D 85/30* (2006.01)
*B65D 81/02* (2006.01)

(52) U.S. Cl. ..... 206/583; 206/586; 206/453

(58) Field of Classification Search ..... 206/583, 206/521, 523, 584, 586, 325, 453, 454, 448, 206/449, 724

See application file for complete search history.

(56) References Cited

U.S. PATENT DOCUMENTS

| | | | | |
|---|---|---|---|---|
| 2,895,599 | A | 7/1959 | Moyer et al | |
| 3,655,034 | A | 4/1972 | Stollman et al | |
| 4,162,729 | A | 7/1979 | Kaiser et al. | |
| 4,583,639 | A | 4/1986 | Fedick et al. | |
| 4,664,254 | A | 5/1987 | Sitwell et al. | |
| 4,892,193 | A | 1/1990 | Thomas | |
| 5,259,523 | A | 11/1993 | Scherb | |
| 5,518,118 | A | 5/1996 | Putz et al. | |
| 5,595,301 | A | 1/1997 | Putz et al. | |
| 6,634,156 | B1 * | 10/2003 | Rutledge | 206/583 |
| 7,422,112 | B1 * | 9/2008 | Harte | 206/583 |

* cited by examiner

*Primary Examiner*—J. Gregory Pickett
(74) *Attorney, Agent, or Firm*—Arthur Jacob

(57) ABSTRACT

A container and method for containing a valued article protected against impact and shock during transportation and storage. The article is packed within an inner case and an inner frame is extended around the inner case, juxtaposed with the inner case at spaced apart locations along the exterior of the inner case. The inner frame is suspended within a circumambient outer frame and is spaced away from the outer frame by shock-absorbent suspenders placed at corresponding spaced apart corners of the inner and outer frames, with open gaps established between the spaced-apart suspenders. Cover members are juxtaposed with the outer frame to extend circumambient over the exterior of the inner case and cover the open gaps between the inner case and the cover members such that the open gaps deter the transmission of impacts from outside the container to the inner case.

17 Claims, 11 Drawing Sheets

PROTECTIVE CONTAINMENT OF VALUED ARTICLES

This application is a continuation-in-part of application Ser. No. 11/203,760, filed Aug. 15, 2005.

The present invention relates generally to the protective containment of valued articles, such as artwork, antiquities, artifacts and valuable collectibles, against damage during transportation and storage and pertains, more specifically, to containers and methods of containment which enable the attainment of a greater level of protection for such items with increased ease of construction and economy of materials.

An ever-increasing mobility being experienced by people and organizations in present-day society has given rise to a need for the safe transport and storage of valued articles, such as artwork, antiquities, artifacts and collectibles. These items frequently are moved over considerable distances from one location to another and require packing systems which will protect against damage to the article being transported or stored in connection with such movement. While numerous packing systems currently are available for the protective containment of articles to be transported or stored, these systems usually are highly elaborate, requiring relatively expensive construction accomplished by skilled workers utilizing sophisticated materials, methods and apparatus.

The present invention enables economical packing of valued articles for transportation and storage with a high degree of protection against damage. As such, the present invention attains several objects and advantages, some of which are summarized as follows: Attains a high level of protection against damage during transportation and storage of a valued article with a relatively economical construction and method; provides a construction and method for isolation of a packed article from deleterious shocks and impacts during transportation and storage of the article, and does so with increased ease, economy and simplicity; enables the accomplishment of effective protective packing of valued articles for transport and storage utilizing readily available materials and requiring only moderate skills, and capable of being completed without the necessity for specialized facilities; maximizes effective protective packing tailored specifically to the particular dimensions and configuration of a valued article, such as artwork, an antiquity or a collectible, with minimal expense, in terms of requirements in materials, labor and facilities; attains consistently reliable results in the protective packing of valued articles with minimal expenditure of time and materials; enables increased ease of unpacking valued articles protected against damage during transport and storage, with minimal risk of damage to the article during unpacking, and with reduced waste of packing materials; provides exemplary performance with increased economy in the effective containment of valued articles over a wide range of shapes and sizes protected against damage during transport and storage.

The above objects and advantages, as well as further objects and advantages, are attained by the present invention which may be described briefly as a container for containing a valued article protected against impact and shock during transportation and storage, the container comprising: an inner case having an outer wall and an interior for receiving the article and a filler material interposed between the article and the outer wall of the inner case, the outer wall including an exterior surface and a circumference bordering the external surface and extending circumferentially around the inner case; an inner frame dimensioned and configured for extending around the circumference of the inner case and for being engaged with the inner case at spaced apart locations along the circumference of the inner case; an outer frame for extending circumambient with respect to the inner frame, the outer frame being dimensioned and configured for being spaced outwardly away from the inner frame upon placement of the outer frame circumambient the inner frame; suspenders for suspending the inner frame from the outer frame at circumferentially spaced apart locations, the suspenders being dimensioned and configured for spacing the outer frame away from the inner frame to establish open gaps along circumferential distances between adjacent suspenders upon suspending the inner frame from the outer frame; the suspenders being constructed of a shock-absorbent material for deterring the transmission of shocks from the outer frame to the inner frame; and outer cover members for being retained in juxtaposition with the outer frame, the cover members being dimensioned and configured to extend circumambient over the external surface of the inner case; the outer frame being further dimensioned and configured for spacing the cover members from the inner case and from the inner frame to cover the open gaps between the inner case and the cover members upon juxtaposition of the cover members with the outer frame; the open gaps deterring the transmission of impacts from outside the container to the inner case.

In addition, the present invention provides a method for protecting an article against impact and shock during transportation and storage, the method comprising: placing the article in an inner case, the inner case having an outer wall including an external surface extending circumferentially around the inner case, and an interior for receiving the article; placing a filler material within the interior of the inner case, interposed between the article and the outer wall of the inner case; extending an inner frame around the circumference of the inner case; engaging the inner frame with the inner case only at spaced apart locations along the circumference of the inner case; extending an outer frame circumambient with respect to the inner frame, and dimensioning and configuring the outer frame so as to space the outer frame outwardly away from the inner frame upon placement of the outer frame circumambient the inner frame; suspending the inner frame from the outer frame at suspenders placed at circumferentially spaced apart locations, and dimensioning and configuring the suspenders so as to space the outer frame from the inner frame and establish open gaps along circumferential distances between adjacent suspenders upon suspending the inner frame from the outer frame; constructing the suspenders of a shock-absorbent material so as to deter the transmission of shocks from the outer frame to the inner frame; retaining cover members in juxtaposition with the outer frame, and dimensioning and configuring the cover members such that the cover members extend over the external surface of the inner case; and further dimensioning and configuring the outer frame so as to space the cover members from the inner case and from the inner frame, and cover the open gaps upon juxtaposition of the cover members to the outer frame; whereby the open gaps will deter the transmission of impacts from outside the container to the inner case.

The invention will be understood more fully, while still further objects and advantages will become apparent, in the following detailed description of preferred embodiments of the invention illustrated in the accompanying drawing, in which.

Figure 1:
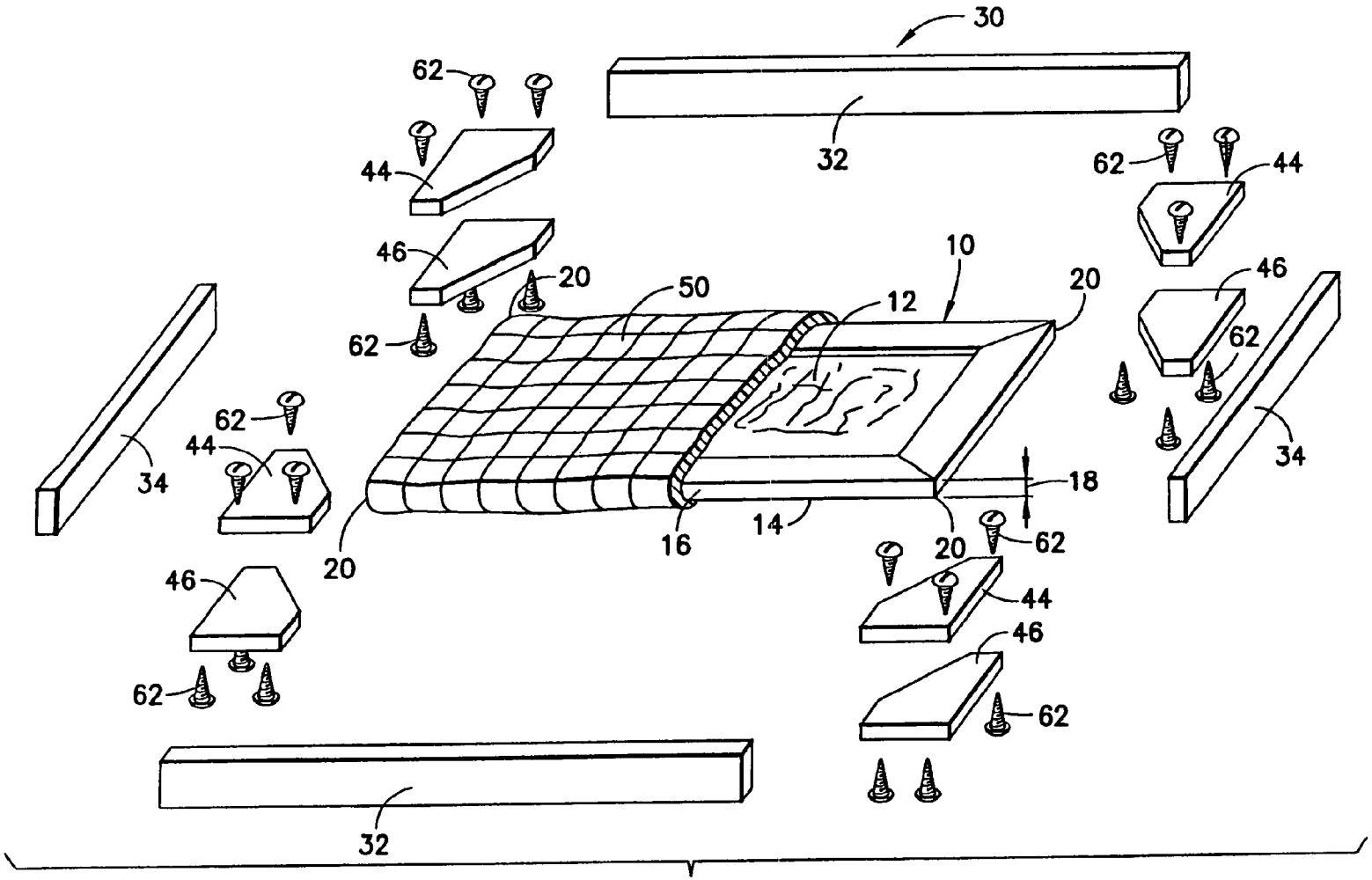
FIG. 1 is an exploded pictorial view showing a portion of a container and method of the present invention.

Referring now to the drawing, and especially to FIG. 1 thereof, a valued article in the form of a piece of artwork is illustrated as a framed painting 10 which is to be packaged for transport, with the framed painting 10 protected against damage during transport, as well as during any storage connected with such transport. Framed painting 10 includes a front face 12, a back face 14 and a perimeter 16 bordering the front face 12 and the back face 14, the perimeter 16 extending longitudinally and laterally perimetrically around the framed painting 10, and a maximum thickness 18 which, in the illustrated artwork, is located along the perimeter 16 and extends in an altitudinal direction. The framed painting 10 is rectangular in plan an includes four corners 20.

A container constructed in accordance with the present invention includes an inner frame 30 having longitudinal frame members 32 and lateral frame members 34. The frame members 32 and 34 are constructed of a relatively inexpensive and rigid material, such as a crate wood or a composition board, and are arranged to extend around the perimeter 16 of the framed painting 10. Upon assembly of the inner frame 30, a rigid corner connection 40 is established at each corner 20 (see FIG. 2), each corner connection 40 including a front gusset 44 and a back gusset 46. The corner connections 40 are dimensioned and configured such that upon affixing the gussets 44 and 46 to the frame members 32 and 34, each corner 20 of the framed painting 10 is received within a complementary recess, illustrated as a triangular recess 48, at each respective corner 20. The fit between each corner 20 and a corresponding recess 48 is snug, and a sheet 50 of resilient packing material, such as commonly available "bubble wrap", may be wrapped around framed painting 10 and interposed between the framed painting 10 and the inner frame 30, including between each corner 20 and a corresponding recess 48, to assure a snug fit and to protect against marring of the framed painting 10.

Figure 2:
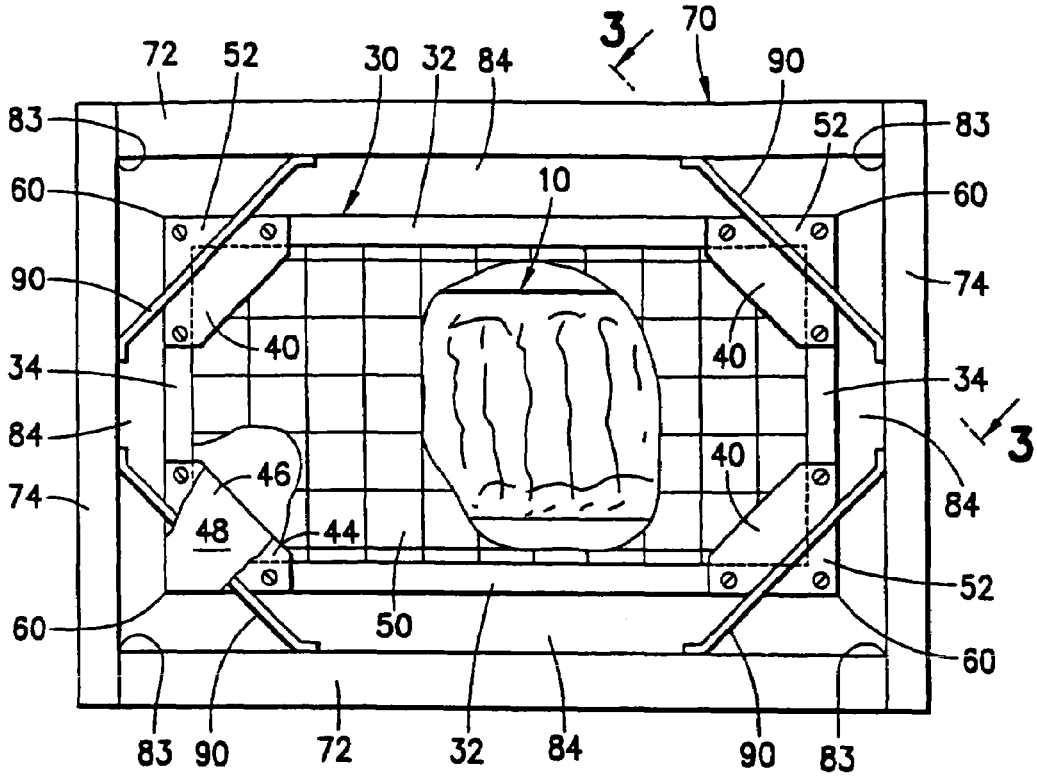
FIG. 2 is a top plan view showing the container during a further stage of the method.

The relative dimensions of the corner connections 40 and the inner frame 30 are such that upon affixing the gussets 44 and 46 to the frame members 32 and 34 to establish the corner connections 40, as seen in FIG. 2, the corner connections 40 are spaced apart from one another along the perimeter 16 of the framed painting 10 to connect the inner frame 30 to the framed painting 10 only at spaced apart locations 52 along the perimeter 16 of the framed painting 10 and thereby establish inner corners 60 corresponding to corners 20 of the wrapped framed painting 10. In the preferred construction, the gussets 44 and 46 of each corner connection 40 are affixed to the frame members 32 and 34 with threaded fasteners 62. The frame members 32 and 34 are secured together at corners 20 by the affixation of gussets 44 and 46 to the frame members 32 and 34. In this manner, framed painting 10 is encased and secured readily within the inner frame 30 utilizing relatively inexpensive materials and commonly available tools and fasteners, requiring only moderate skills. The thus encased framed painting 10 has an overall altitudinal height 66, as seen in FIG. 3.

Figure 4:
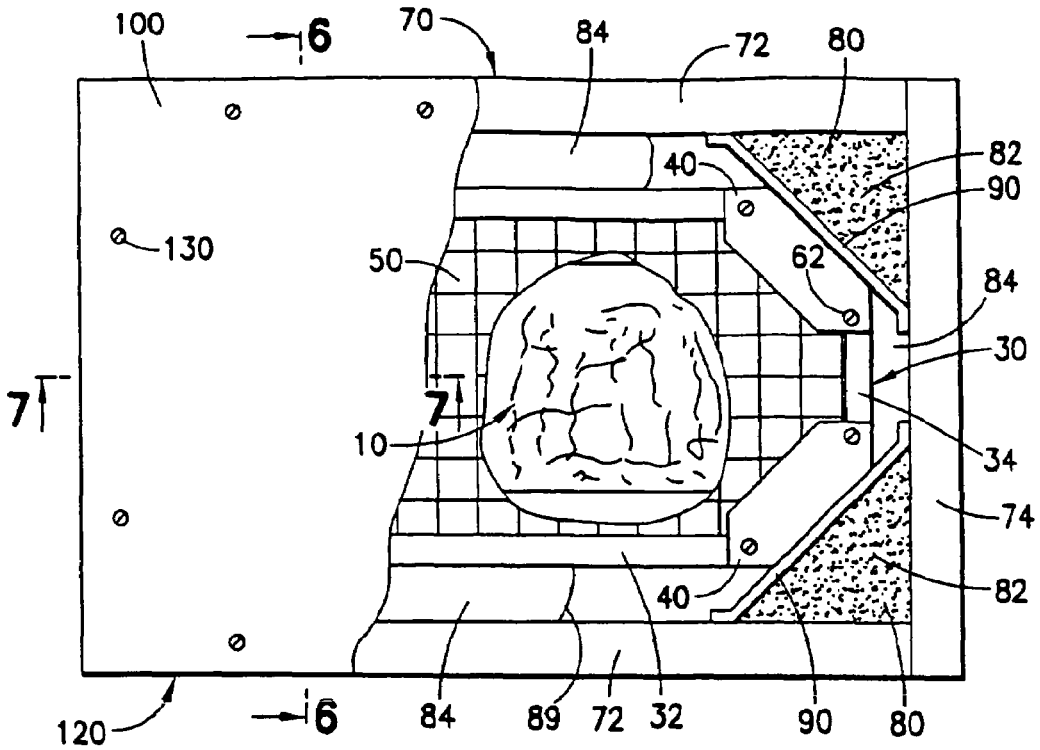
FIG. 4 is a top plan view showing a valued article fully contained in accordance with the present invention.

Once the inner frame 30 is assembled and secured about the framed painting 10, an outer frame 70 is extended perimetrically around the inner frame 30, and the inner frame 30, with the framed painting 10, is suspended within the outer frame 70. Outer frame 70 includes longitudinal frame members 72 and lateral frame members 74 assembled into a rectangular outer frame 70 dimensioned and configured for being spaced outwardly away from the inner frame 30 upon placement of the outer frame 70 perimetrically around inner frame 30. As seen in FIG. 4, suspenders in the form of corner suspenders 80 then suspend the inner frame 30 from the outer frame 70 only at four perimetrically spaced apart locations 82, shown at inner corners 60 corresponding to the four corners 20, the corner suspenders 80 being dimensioned and configured for spacing the outer frame 70 outwardly from the inner frame 30 to establish outer corners 83 spaced from corresponding inner corners 60 and to establish open gaps 84 along perimetric distances between adjacent suspenders 80. Additionally, the outer frame 70 is provided with an altitudinal height 86 between front and back edges 87 and 88, respectively, altitudinal height 86 being greater than the corresponding altitudinal height 66 of the encased framed painting 10, for purposes to be set forth below. The outer frame 70 is constructed readily and economically from an inexpensive material, such as crate wood, and has a simple rectangular configuration. The suspenders 80 are constructed of a shock-absorbent material for deterring the transmission of shocks from the outer frame 70 to the inner frame 30. A preferred material for suspenders 80 is a polyurethane foam available commercially from Alta Packaging Inc. under the name INSTAPAK.

Figure 3:
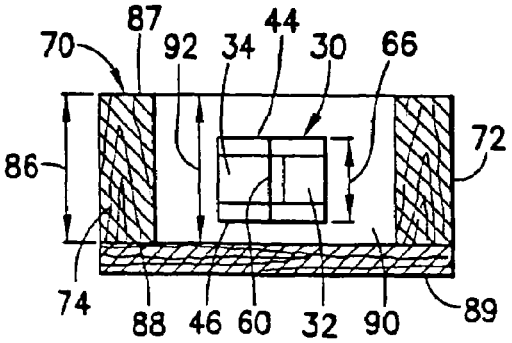
FIG. 3 is a cross-sectional view taken along line 3-3 of FIG. 2.

In a preferred method of suspending the inner frame 30 from the outer frame 70, a back cover 89 is affixed to the back edges 88 of the outer frame 70 to close the back of the container, spacers are placed at each corner of the inner frame 30, and the assembled inner frame 30 and framed painting 10, with spacers 90 in place, is nested within frame 70, as seen in FIGS. 2 and 3. The spacers 90 extend across each corner of the inner frame 30 and a corresponding corner of the outer frame 70 and locate the inner frame 30 within the outer frame 70, appropriately spaced from the outer frame 70. In addition, the spacers 90 have an altitudinal height 92 corresponding to the height 86 between the front and back edges 87 and 88 of the outer frame 70 and are fitted over the inner corners 60 of the encased framed painting 10 to space the inner frame 30, and the encased framed painting 10, from each of the front and back edges 87 and 88 of the outer frame.

Figure 5:
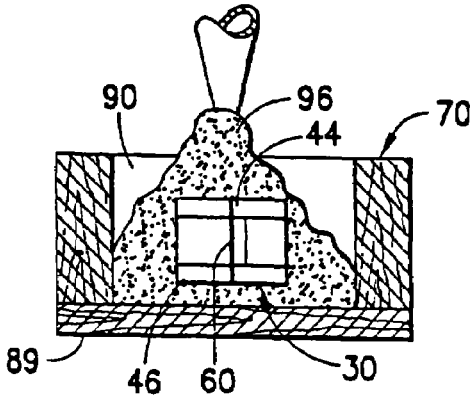
FIG. 5 is a cross-sectional view similar to FIG. 3 and showing a still further stage of the method.

Polyurethane foam 96 in fluid form then is injected into each corner, between the inner frame 30 and the outer frame 70, as seen in FIG. 5, and, with the spacers 90 serving as dams to confine the fluid foam 96 to the corners, the foam is allowed to set. Once the foam is set, the inner frame 30 is suspended from the outer frame by fully formed polyurethane suspenders 80 at each corner 60 and 83 of the assembled inner and outer frames 30 and 70, respectively, which suspenders 80 isolate the inner frame 30, and consequently the encased framed painting 10, from shocks which otherwise could be transmitted from the outer frame 70 to the inner frame 30. It is noted that the spacers 90 are constructed of a relatively weak material, such as paper or cardboard, which can serve temporarily as a spacer and a dam, allowing the suspenders 80 to be formed in situ, as described above, but which is incapable of transmitting shocks from the outer frame 70 to the inner frame 30.

Figure 6:
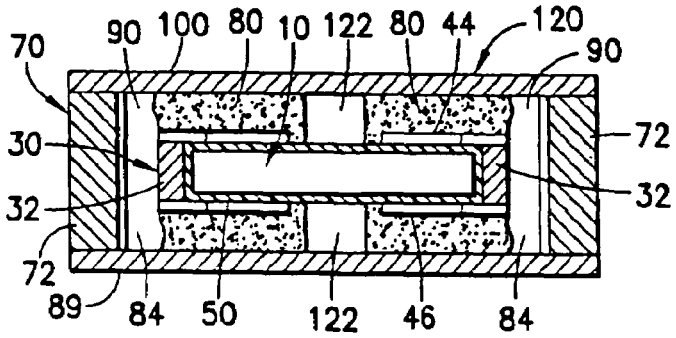
FIG. 6 is a cross-sectional view taken along line 6-6 of FIG. 4.
Figure 7:
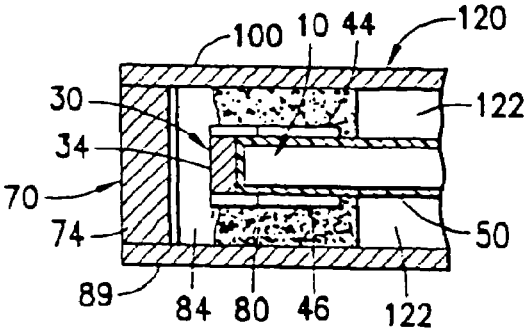
FIG. 7 is a cross-sectional view taken along line 7-7 of FIG. 4.

Once the inner frame 30 is suspended from the outer frame 70, as seen in FIGS. 4, 6 and 7, a front cover 100 is secured to the front edge 87 of the outer frame 70 to fully contain the framed painting 10 within a completed container 120. When thus fully contained, framed painting 10 is suspended only at limited locations, that is, at corners 20, and is isolated from shocks by suspenders 80. In addition, the open gaps 84 established between the outer frame 70 and the inner frame 30, and further open gaps 122 established between the front cover 100 and the framed painting 10, and between the back cover 89 and the framed painting 10, as seen in FIGS. 6 and 7, deter the transmission of impacts from outside the container 120 to the framed painting 10. The open gaps 84 and 122, contain no material which could transmit impacts, and serve as simple barriers against the transmission of impacts to the framed painting 10. Moreover, by suspending the contained article at limited locations along the perimeter of the article, as illustrated by the suspension of framed painting 10 at corners 20, container 120 readily is tailored to articles having a wide variety of shapes in a wide range of sizes. In the preferred construction, the front and back covers 100 and 89 are secured to the outer frame 70 with threaded fasteners 130.

When it is desired to remove the framed painting 10 from the container 120, threaded fasteners 130 are withdrawn readily to enable removal of at least one of the front and back covers 100 and 89. Portions of the suspenders 80 readily are cut away from the corner connections 40 to expose threaded fasteners 62 which then are removed with ease to allow removal of a gusset 44 or 46 from each corner connection 40. Once a gusset 44 or 46 is removed from each corner connection 40, the framed painting 10 may be lifted from the inner frame 30 fully intact and unharmed. In an alternate construction, since only one of the gussets 44 or 46 need be removed at each corner 20 in order to release framed painting 10 from inner frame 30, the removable gusset may be secured within inner frame 30 with selectively removable threaded fasteners 62, while the other gusset may be secured within inner frame 30 with an alternate affixation arrangement, such as with an adhesive.

Figure 8:
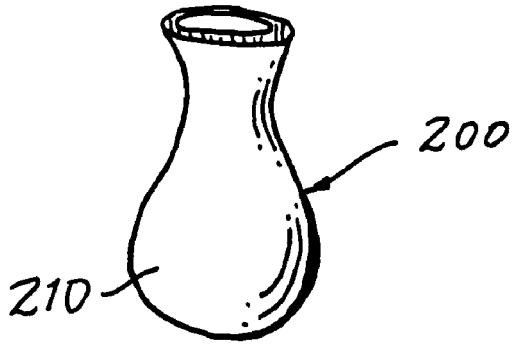
FIG. 8 is a pictorial depiction of a valuable article to be protectively contained in accordance with the present invention.

Referring now to the embodiment illustrated in FIGS. 8 through 22, a valued article is shown in FIG. 8 in the form of a delicate vessel 200 which is to be packaged for transport, with the vessel 200 protected against damage during transport, as well as during any storage connected with such transport. Vessel 200 includes a contoured exterior having an external surface 210 extending longitudinally and laterally along the vessel 200 for circumferentially bordering the exterior of the vessel 200.

Figure 9:
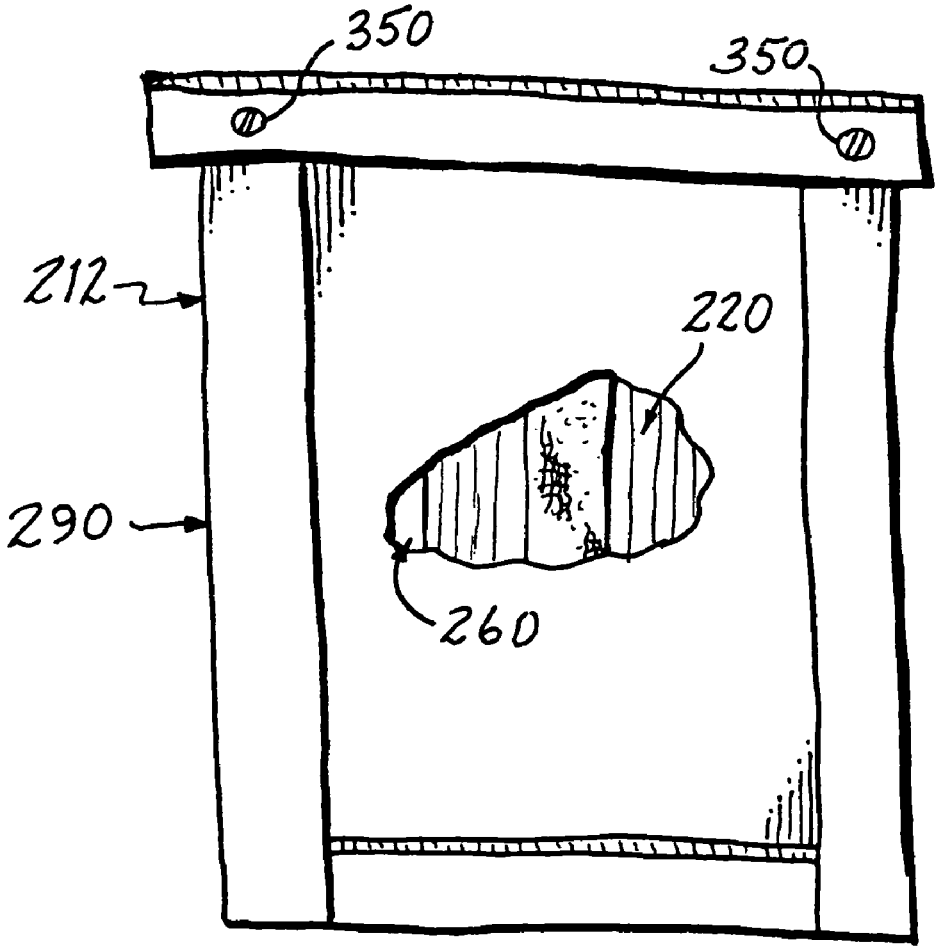
FIG. 9 is a side elevational view of a container constructed in accordance with the present invention.
Figure 10:
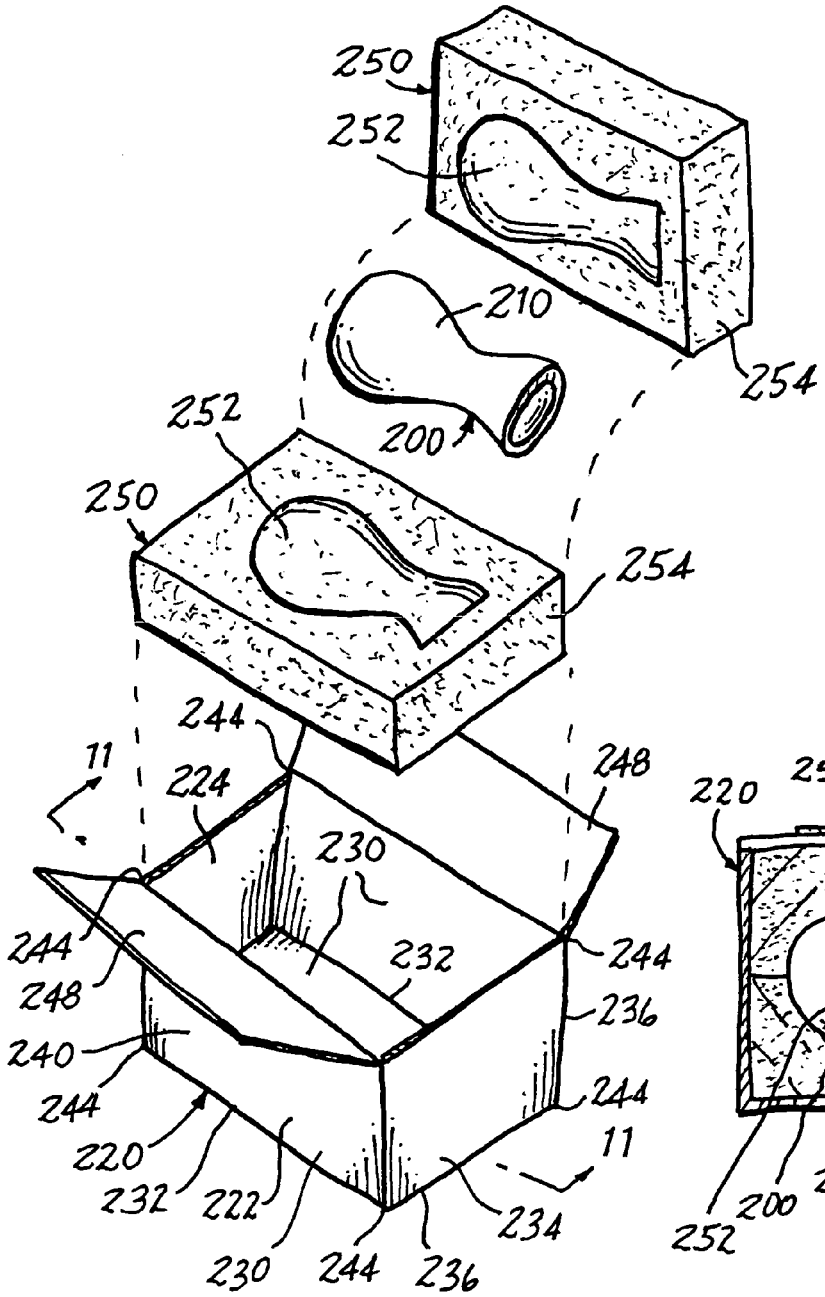
FIG. 10 is an exploded pictorial view showing a portion of the container and method of the present invention.
Figure 11:
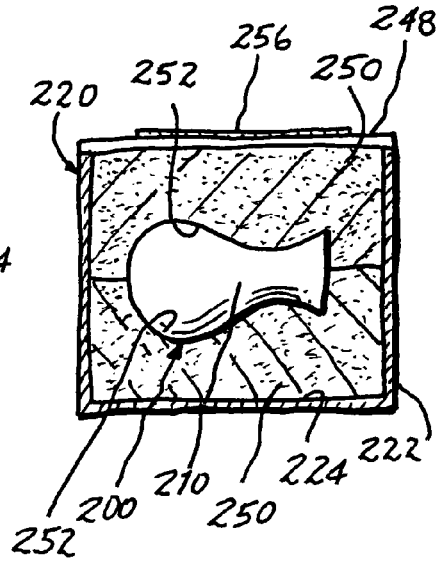
FIG. 11 is a cross-sectional view taken along line 11-11 of FIG. 10.
Figure 12:
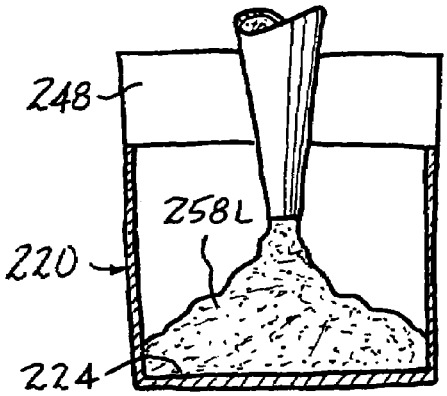
FIGS. 12 through 15 are somewhat diagrammatic cross-sectional depictions of structural features and procedural steps in accordance with the present invention.
Figure 13:
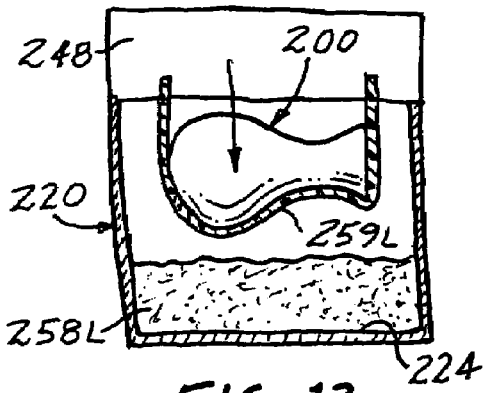
Figure 14:
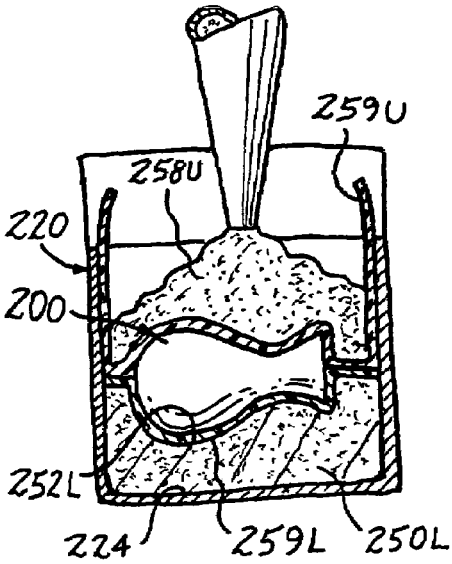

A container constructed in accordance with this embodiment of the present invention is shown in FIG. 9 at 212 and includes an inner case 220 within which the vessel 200 is packaged. Turning now to FIGS. 10 and 11, inner case 220 has an outer wall 222 and an interior 224 for receiving the vessel 200. Inner case 220 preferably includes a generally parallelepiped configuration having longitudinal sides 230 intersecting along longitudinal edges 232, and lateral ends 234 intersecting the longitudinal sides 230 along lateral edges 236, all providing an exterior surface 240 with a circumference bordering the exterior surface 240 and extending circumferentially around the inner case 220. The exterior surface 240 of inner case 220 includes a plurality of circumferentially spaced-apart corners 244, the parallelepiped configuration providing eight such corners 244. In the illustrated embodiment, access to the interior 224 of the inner case 220 is provided by constructing one of the sides 230 in the form of flaps 248 which are selectively opened, as shown in FIG. 10, to admit the vessel 200, packaged as described below.

As seen in FIGS. 10 through 15, vessel 200 is cradled and confined within filler material illustrated in the form of two filler blocks 250, each having a recess 252 contoured essentially complementary to a corresponding portion of the external surface 210 of the vessel 200, and an external configuration 254 complementary to at least portions of the interior 224 of the inner case 220. Upon placement of the vessel 200 between the two filler blocks 250, with the vessel 200 nested within the recesses 252, and with the filler blocks 250 and the vessel 200 placed within the interior 224 of the inner case 220, the filler blocks 250 are interposed between the vessel 200 and the outer wall 222 of the inner case 220, the flaps 248 are closed, and preferably sealed shut with a length of packing tape 256, and the vessel 200 is securely packaged within the inner case 220. Filler blocks 250 preferably are constructed of a somewhat rigid, light-weight synthetic polymeric foamed material, such as a polyurethane foam which confines the vessel 200 against movement within the inner case 220.

Figure 15:
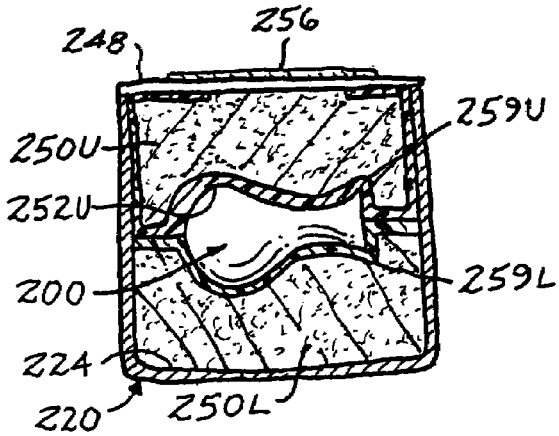

In the illustrated embodiment, the inner case 220 is constructed of corrugated cardboard. In a preferred method of packaging vessel 200, the filler blocks 250 are formed in situ by first pouring a volume of fluid polyurethane foam into inner case 220, as seen at 258L in FIG. 12, sufficient to establish a lower filler block 250L (see FIGS. 14 and 15) and then, with a suitable lower parting sheet 259L placed around the vessel 200 and over the still-fluid poured volume 258L of polyurethane foam, pressing the vessel 200 into the poured volume 258L, while at the same time establishing lower recess 252L. Then, an upper parting sheet 259U is placed over vessel 200 and a sufficient volume of fluid polyurethane foam is poured over the vessel 200, as seen at 258U in FIG. 14, and over the lower filler block 250L to establish upper filler block 250U, with upper recess 252U. Once the fluid polyurethane foam is cured, the vessel 200 will be securely cradled and confined within recesses 252 of the filler blocks 250, and the filler blocks 250 will be fitted securely within the interior 224 of the inner case 220, as seen in FIG. 15. Subsequent removal of the vessel 200 from the inner case 220 is facilitated by the parting sheets 259L and 259U.

Figure 16:
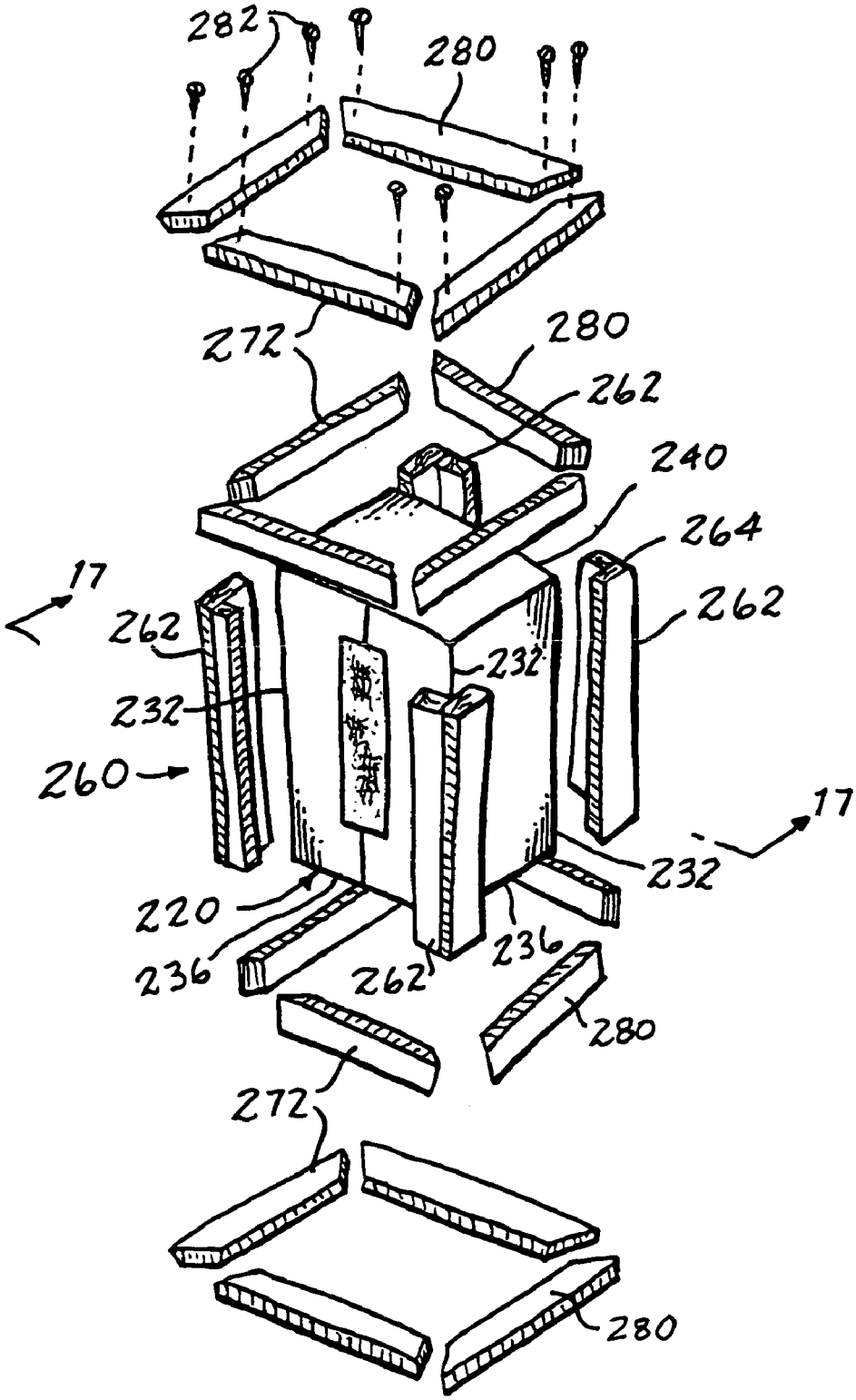
FIG. 16 is an exploded pictorial view showing another portion of the container and method of the present invention.
Figure 17:
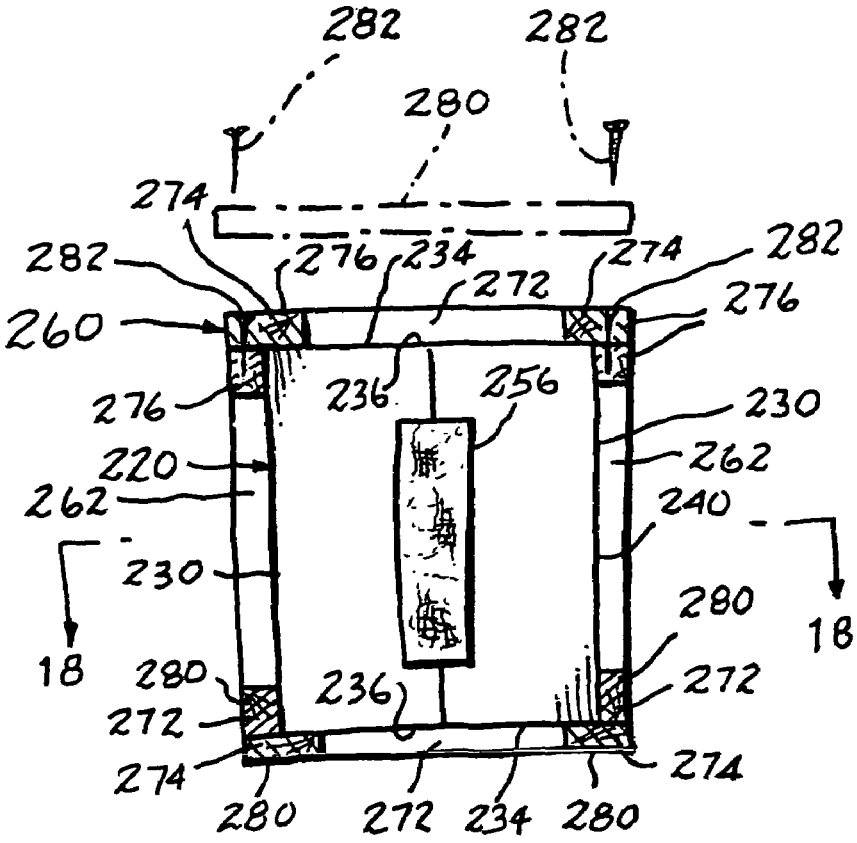
FIG. 17 is an enlarged cross-sectional view taken along line 17-17 of FIG. 16.
Figure 18:
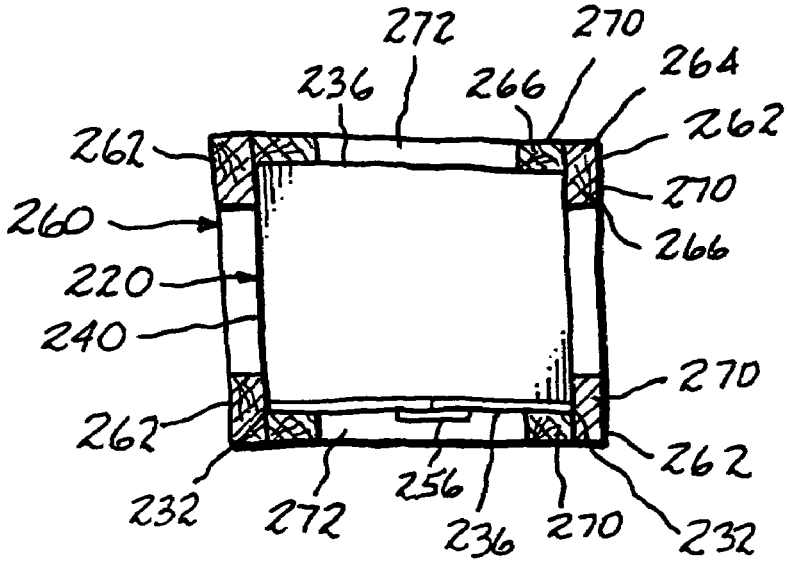
FIG. 18 is a cross-sectional view taken along line 18-18 of FIG. 17.
Figure 19:
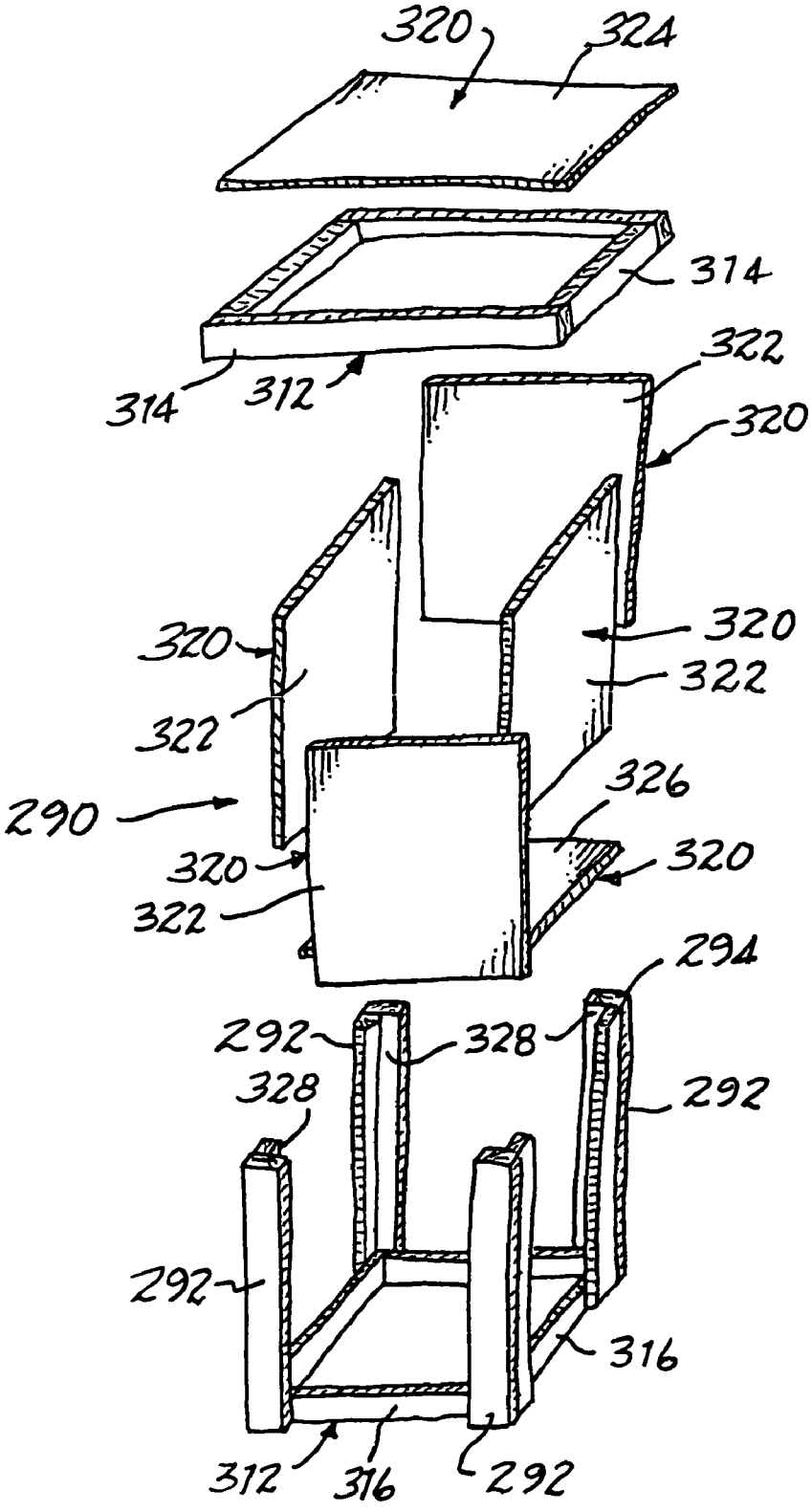
FIG. 19 is an exploded pictorial view showing a further portion of the container and method of the present invention.
Figure 20:
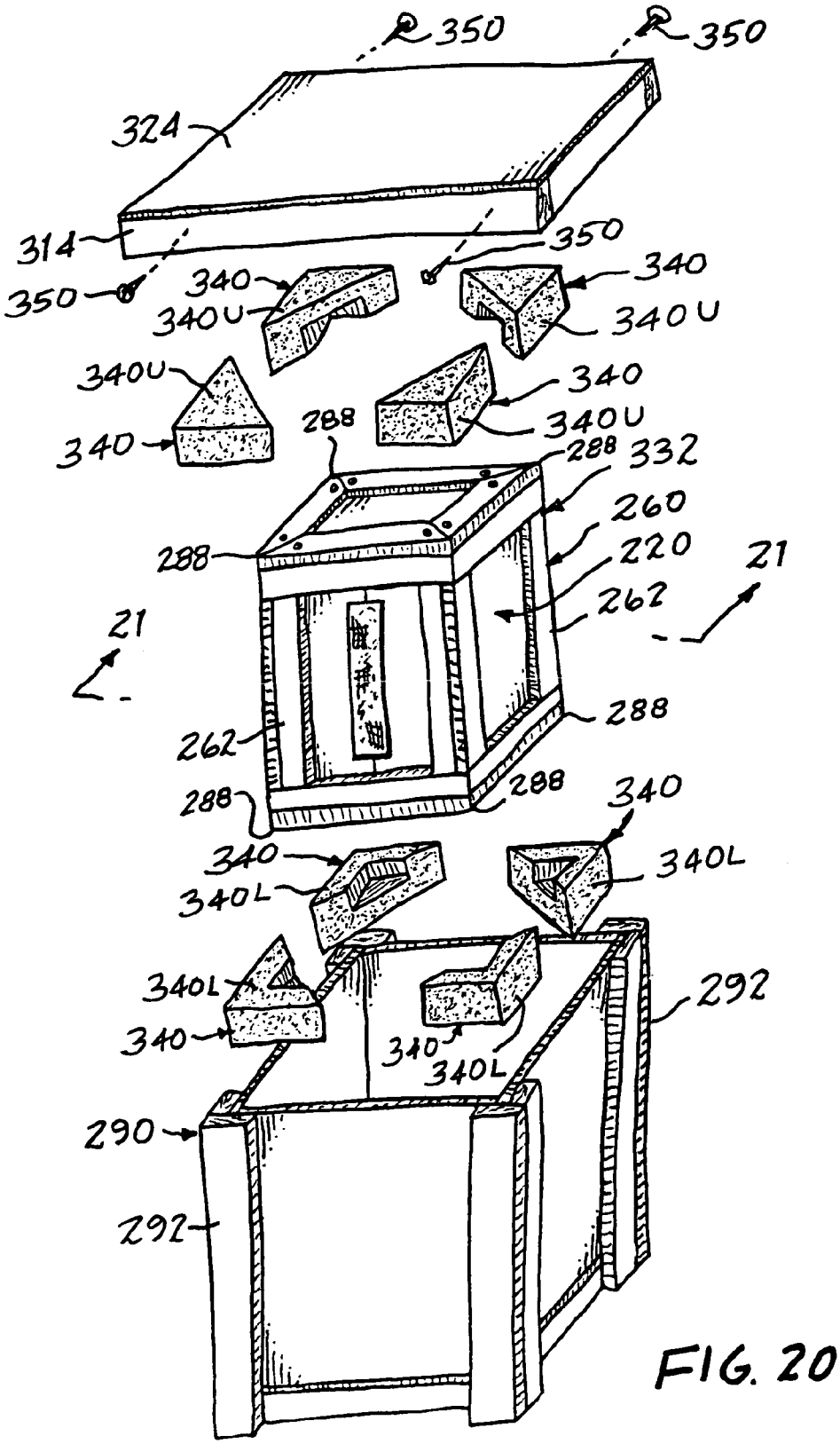
FIG. 20 is an exploded pictorial view showing a still further portion of the container and method of the present invention.
Figure 21:
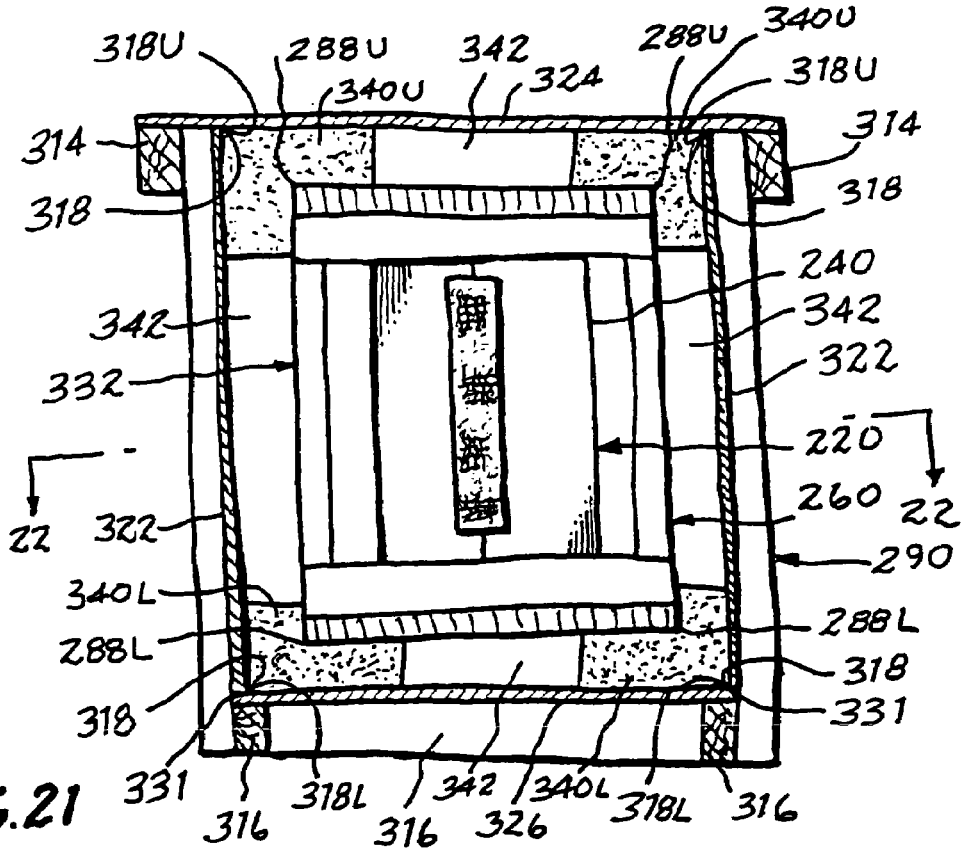
FIG. 21 is an enlarged cross-sectional view taken along line 21-21 of FIG. 20.
Figure 22:
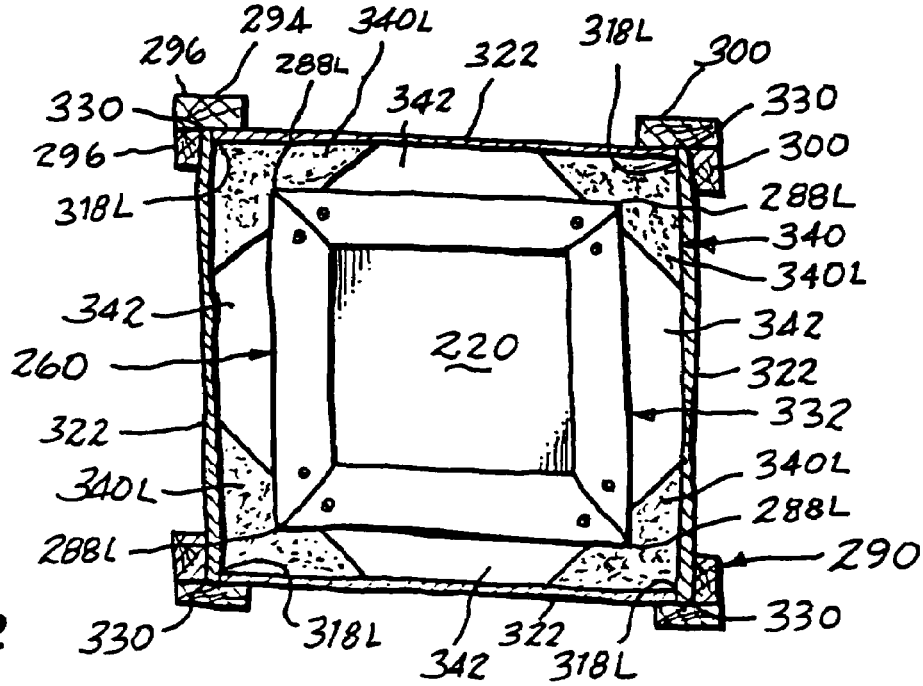
FIG. 22 is a cross-sectional view taken along line 22-22 of FIG. 21.

Once the vessel 200 is securely packaged within the inner case 220, an inner frame 260 is extended around the circumference of the inner case 220, as seen in FIGS. 16 through 18. Inner frame 260 is dimensioned and configured for extending around the circumference of inner case 220 and for being engaged with inner case 220 at spaced apart locations along the circumference of inner case 220. To that end, inner frame 260 preferably is built around inner case 220 as follows. Inner longitudinal members 262 are extended along corresponding longitudinal edges 232 of the inner case 220. Longitudinal members 262 each are constructed with a transverse cross-sectional configuration 264 which complements the exterior surface 240 of the inner case 220 along the longitudinal edges 232 for an essentially snug reception of each longitudinal edge 232 within a longitudinal member 262. In the illustrated embodiment, longitudinal cross-sectional configuration 264 is L-shaped, with each leg 266 of the L-shaped cross-sectional configuration extending in a lateral direction over at least a limited portion of the sides 230 of the inner case 220 such that adjacent longitudinal members 262 are spaced apart laterally and establish an open construction which conserves material and weight while providing requisite strength and rigidity. In the preferred construction, each longitudinal member 262 is made up of two boards 270 of relatively inexpensive material, such as crate wood, each board 270 having a rectangular cross-sectional configuration and the two boards 270 being joined together along the lengths of the boards 270, as by an adhesive or by nailing, or by both, to establish the L-shaped cross-sectional configuration 264.

Inner lateral members 272 are extended along corresponding lateral edges 236 of the inner case 220 and are affixed to the inner longitudinal members 262, adjacent the ends of the longitudinal members 262, to provide the inner frame 260 with cage-like structure circumambient the inner case 220, with the inner case 220 firmly seated and confined within the inner frame 260. Similar to that described in connection with longitudinal members 262, lateral members 272 are each constructed with a transverse cross-sectional configuration 274 which complements the exterior surface 240 of the inner case 220 along the lateral edges 236 for an essentially snug reception of each lateral edge 236 within a lateral member 272. In the illustrated embodiment, lateral cross-sectional configuration 274 is L-shaped, with the legs 276 of the L-shaped cross-sectional configuration 274 extending in either a longitudinal direction over at least a limited portion of the sides 230 of the inner case 220 or in a lateral direction over at least a limited portion of the ends 234 of the inner case 220 such that longitudinally adjacent lateral members 272 are spaced apart longitudinally between adjacent longitudinal members 262, and laterally adjacent lateral members 272 are spaced apart laterally to establish an open structure which provides requisite strength with minimum material and limited weight.

In the preferred construction, each lateral member 272 is made up of two boards 280 of relatively inexpensive material, such as crate wood, the boards 280 having a rectangular cross-sectional configuration and joined together along the lengths of the boards 280 to establish the L-shaped cross-sectional configuration 274. However, in order to provide access into the cage-like structure of the inner frame 260 for ease of selective removal of the inner case 220 from the inner frame 260 when the vessel 200 is to be unpacked, at least the boards 280 of lateral members 272 located at one end of the inner frame 260 are fastened together with screws 282 which are withdrawn readily to facilitate access into the inner frame 260, as depicted in phantom in FIG. 17, for subsequent removal of the inner case 220. With the inner case 220 firmly and securely held within inner frame 260, the longitudinal members 262 and the lateral members 272 intersect at and establish inner frame corners 288.

Once the inner case 220 is secured within the inner frame 260, as seen in FIGS. 17 and 18, an outer frame 290 is extended circumambient with respect to the inner frame 260, as illustrated in FIGS. 19 through 22, the outer frame 290 being dimensioned and configured for spacing the outer frame 290 away from the inner frame 260, circumambient the inner frame 260. To that end, outer frame 290 includes outer longitudinal members 292 for extending generally parallel to and spaced outwardly from corresponding inner longitudinal members 262 of the inner frame 260. Outer longitudinal members 292 each have a transverse cross-sectional configuration 294 and, in the illustrated embodiment, longitudinal cross-sectional configuration 294 is L-shaped, with each leg 296 of the L-shaped cross-sectional configuration 294 extending in a lateral direction for purposes set forth below.

In the preferred construction, each longitudinal member 292 is made up of two boards 300 of relatively inexpensive material, such as crate wood, each board 300 having a rectangular cross-sectional configuration and joined together along the lengths of the boards 300, as by an adhesive or with suitable fasteners, or both, to establish the L-shaped cross-sectional configuration 294. Outer lateral members 312 are dimensioned and configured for extending generally parallel to and being spaced away from corresponding inner lateral members 272 of the inner frame 260, the outer lateral members 312 including upper end members 314 and lower end members 316. In the preferred construction, the outer lateral members 312 are provided in the form of boards of inexpensive material, such as crate wood, and the lower end members 316 are affixed to corresponding lower ends of the longitudinal members 292, as by an adhesive or with suitable fasteners, or both. With the outer lateral members 312 affixed to corresponding ends of the outer longitudinal members 292, as will be described in more detail below, outer longitudinal members 292 and outer lateral members 312 intersect to establish outer frame corners 318.

Outer cover members 320 are juxtaposed with the outer frame 290 and are dimensioned and configured for extending circumambient over and spaced away from the exterior surface 240 of the inner case 220. The cover members 320 include side panels 322 juxtaposed with the outer frame 290, with the side panels 322 extending along the outer longitudinal members 292, an upper end panel 324 secured to the upper end members 314 for subsequent juxtaposition with the outer frame 290, with the upper end panel 324 extending along the upper end members 314, and a lower end panel 326 for being juxtaposed with the outer frame 290, with the lower end panel 326 extending along the lower end members 316. In the preferred construction, the side panels 322 are juxtaposed with the outer longitudinal members 292 along the inside surfaces 328 of the L-shaped configuration 294, and the lower end panel 326 is seated upon the lower end members 316, and are retained in place as will be described below. Moreover, by placing the side panels 322 along the inside surfaces 328 and resting the lower end panel 326 along the lower end members 316, the outer longitudinal members 292 and the lower end members 316 are exposed for added protection against impacts directed against longitudinal edges 330 where the side panels 322 are joined with the outer longitudinal members 292 and the lateral edges 331 where the side panels 322 and the lower end panel 326 are joined with the lower end members 316. The side panels 322, upper end panel 324 and lower end panel 326 are constructed of a high-strength, rigid material, such as commercially available hardboard.

With the vessel 200 packaged within the inner case 220, and the inner case 220 confined within the inner frame 260, as described above, the assembly 332 comprising inner case 220 and inner frame 260 is suspended within the outer frame 290 by suspenders 340 placed at circumferentially spaced apart locations, the suspenders 340 being dimensioned and configured for spacing the outer frame 290 away from the inner frame 260 to establish open gaps 342 along circumferential distances between adjacent suspenders 340 upon suspending the inner frame 260 from the outer frame 290. Suspenders 340 are constructed of a shock-absorbing material, such as a foamed synthetic polymeric material, an example of which is an available polyurethane foam, described above, for deterring the transmission of shocks from the outer frame 290 to the inner frame 260.

In the preferred construction, lower suspenders 340L are placed within the outer frame 290 prior to affixing the upper end members 314, and the upper end panel 324 secured to the upper end members 314, to the outer longitudinal members 292, with the lower suspenders 340L fitted into corresponding lower outer frame corners 318L. At the same time, lower suspenders 340L serve to retain side panels 322 and lower end panel 326 in place at lower outer frame corners 318L. The lower suspenders 340L may be formed in situ in a manner somewhat similar to the in situ formation described above in connection with filler blocks 250. Then, assembly 332 is placed within outer frame 290, with inner frame corners 288L seated adjacent corresponding outer frame corners 318L. Once the inner frame 260 is seated within the outer frame 290, upper suspenders 340U are fitted at upper outer frame corners 318U to corresponding inner frame corners 288U. At the same time, upper suspenders 340U serve to retain side panels 322 in place at upper outer frame corners 318U. Supplemental fasteners (not shown) may be employed to secure side panels 322 along corresponding outer longitudinal members 292. Upper lateral members 314 then are affixed to corresponding upper ends of outer longitudinal members 292, preferably by screws 350 (also see FIG. 1), to fully close the container 212.

With the container 212 fully closed, the open gaps 342, which now extend between the inner and outer frames 260 and 290, are circumambient with respect to the inner case 220 and deter the transmission of impacts from outside the container 212 to the inner case 220, and the vessel 200 is effectively isolated against damage during transport and storage. A spacing of approximately four inches between the inner and outer frames 260 and 290 has been found to provide effective gaps 342. Access to the vessel 200 is attained readily for unpacking of the vessel 200 merely by removing screws 350, lifting the upper lateral members 314, and attached upper end panel 324 to gain access to the inner frame 260, then withdrawing the inner frame 260 from the outer frame 290, and removing screws 282 to release corresponding boards 280 and open access to inner case 220. Once inner case 220 is withdrawn from inner frame 260, packing tape 256 is released, flaps 248 are opened and the filler blocks 250 are separated to gain access the vessel 200.

It will be seen that the present invention attains all of the objects and advantages summarized above, namely: Attains a high level of protection against damage during transportation an storage of a valued article with a relatively economical construction and method; provides a construction and method for isolation of a packed article from deleterious shocks and impacts during transportation and storage of the article, and does so with increased ease, economy and simplicity; enables the accomplishment of effective protective packing of valued articles for transport and storage utilizing readily available materials and requiring only moderate skills, and capable of being completed without the necessity for specialized facilities; maximizes effective protective packing tailored specifically to the particular dimensions and configuration of a valued article, such as artwork, an antiquity or a collectible, with minimal expense, in terms of requirements in materials, labor and facilities; attains consistently reliable results in the protective packing of valued articles with minimal expenditure of time and materials; enables increased ease of unpacking valued articles protected against damage during transport and storage, with minimal risk of damage to the article during unpacking, and with reduced waste of packing materials; provides exemplary performance with increased economy in the effective containment of valued articles over a wide range of shapes and sizes protected against damage during transport and storage.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A container for containing a valued article protected against impact and shock during transportation and storage, the container comprising:

an inner case having an outer wall and an interior for receiving the article and a filler material interposed between the article and the outer wall of the inner case, the outer wall including an exterior surface and a circumference bordering the external surface and extending circumferentially around the inner case;

an inner frame dimensioned and configured for extending around the circumference of the inner case and for being engaged with the inner case at spaced apart locations along the circumference of the inner case;

an outer frame for extending circumambient with respect to the inner frame, the outer frame being dimensioned and configured for being spaced outwardly away from the inner frame upon placement of the outer frame circumambient the inner frame;

suspenders for suspending the inner frame from the outer frame at circumferentially spaced apart locations, the suspenders being dimensioned and configured for spacing the outer frame away from the inner frame to establish open gaps along circumferential distances between adjacent suspenders upon suspending the inner frame from the outer frame;

the suspenders being constructed of a shock-absorbent material for deterring the transmission of shocks from the outer frame to the inner frame; and outer cover members for being retained in juxtaposition with the outer frame, the cover members being dimensioned and configured to extend circumambient over the external surface of the inner case;

the outer frame being further dimensioned and configured for spacing the cover members from the inner case and from the inner frame to cover the open gaps between the inner case and the cover members upon juxtaposition of the cover members with the outer frame;

the open gaps deterring the transmission of impacts from outside the container to the inner case.

2. The container of claim 1 wherein the external surface of the inner case includes a plurality of circumferentially spaced-apart corners, and the suspenders are located at the corners upon suspending the inner frame from the outer frame.

3. The container of claim 2 wherein the suspenders are constructed of a foamed synthetic polymeric material.

4. The container of claim 3 wherein the foamed synthetic polymeric material is a polyurethane foam.

5. The container of claim 4 wherein:

the inner frame includes inner corners corresponding to corners of the external surface of the inner case;

the outer frame includes outer corners corresponding to the inner corners for being spaced a distance from respective corresponding inner corners; and the suspenders are dimensioned and configured for spanning the distance between the corresponding spaced apart inner and outer corners.

6. The container of claim 2 wherein:

the inner case includes a generally parallelepiped configuration having longitudinally extending sides intersecting along longitudinal edges, and lateral ends intersecting the longitudinal sides along lateral edges, the spaced apart corners of the inner case being located at the intersections between longitudinal edges and lateral edges;

the inner frame includes inner longitudinal members for extending along corresponding longitudinal edges of the inner case, and inner lateral members for extending along corresponding external edges of the inner case, the longitudinal members and the lateral members intersecting to establish inner frame corners dimensioned, configured and located to receive respective corners of the inner case and confine the inner case within the inner frame;

the outer frame includes outer longitudinal members for extending generally parallel to and spaced away from the inner longitudinal embers, and outer lateral members for extending generally parallel to and spaced away from corresponding inner lateral members, the outer longitudinal members and the outer lateral members intersecting to establish outer frame corners for juxtaposition with and for being spaced from corresponding inner frame corners;

the suspenders are dimensions and configured for interposition between corresponding inner and outer frame corners upon suspending the inner frame within the outer frame; and the cover members include side panels for juxtaposition with the outer frame, with the side panels extending along the outer longitudinal members, and end panels for juxtaposition with the outer frame with the end panels extending along the outer lateral members.

7. The container of claim 6 wherein the suspenders are constructed of a foamed synthetic polymeric material.

8. The container of claim 7 wherein the foamed synthetic polymeric material is a polyurethane foam.

9. The container of claim 1 wherein the suspenders are constructed of a foamed synthetic polymeric material.

10. The container of claim 9 wherein the foamed synthetic polymeric material is a polyurethane foam.

11. A method for protecting an article against impact and shock during transportation and storage, the method comprising:

placing the article in an inner case, the inner case having an outer wall including an external surface extending circumferentially around the inner case, and an interior for receiving the article;

placing a filler material within the interior of the inner case, interposed between the article and the outer wall of the inner case;

extending an inner frame around the circumference of the inner case;

engaging the inner frame with the inner case only at spaced apart locations along the circumference of the inner case;

extending an outer frame circumambient with respect to the inner frame, and dimensioning and configuring the outer frame so as to space the outer frame outwardly away from the inner frame upon placement of the outer frame circumambient the inner frame;

suspending the inner frame from the outer frame at suspenders placed at circumferentially spaced apart locations, and dimensioning and configuring the suspenders so as to space the outer frame from the inner frame and establish open gaps along circumferential distances between adjacent suspenders upon suspending the inner frame from the outer frame;

constructing the suspenders of a shock-absorbent material so as to deter the transmission of shocks from the outer frame to the inner frame;

retaining cover members in juxtaposition with the outer frame, and dimensioning and configuring the cover members such that the cover members extend over the external surface of the inner case; and further dimensioning and configuring the outer frame so as to space the cover members from the inner case and from the inner frame, and cover the open gaps upon juxtaposition of the cover members to the outer frame;

whereby the open gaps will deter the transmission of impacts from outside the container to the inner case.

12. The method of claim 11 wherein the external surface of the inner case includes a plurality of circumferentially spaced-apart corners, the method including locating the suspenders at the corners.

13. The method of claim 12 including constructing the suspenders of a foamed synthetic polymeric material.

14. The method of claim 12 including constructing the suspenders of a polyurethane foam.

15. The method of claim 14 including:

dimensioning and configuring the inner frame to include inner corners corresponding to corners of the external surface of the inner case;

dimensioning and configuring the outer frame to include outer corners corresponding to the inner corners and spaced a distance from respective corresponding inner corners; and placing the suspenders to span the distance between the corresponding spaced apart inner and outer corners.

16. The method of claim 11 including constructing the suspenders of a foamed synthetic polymeric material.

17. The method of claim 11 including constructing the suspenders of a polyurethane foam.

* * * * *